United States Patent [19]

Tsuchiya

[11] Patent Number: 4,813,092

[45] Date of Patent: Mar. 21, 1989

[54] DUST REFLECTING AND INTRODUCING PLATE IN CLEANER

[75] Inventor: Toshihiro Tsuchiya, Chiba, Japan

[73] Assignee: Kabushiki Kaisha Hoky, Chiba, Japan

[21] Appl. No.: 124,687

[22] Filed: Nov. 24, 1987

[30] Foreign Application Priority Data

Jul. 1, 1987 [JP] Japan ..... 62-101644[U]

[51] Int. Cl.[4] ..... A47L 11/33

[52] U.S. Cl. ..... 15/41 R

[58] Field of Search ..... 15/41–46, 15/48, 49 C, 50 L, 79 R, 79 A, 83, 383

[56] References Cited

U.S. PATENT DOCUMENTS

| | | | |
|---|---|---|---|
| 1,267,304 | 5/1918 | Adams | 15/41 R |
| 4,646,380 | 3/1987 | Kobayashi . | |

FOREIGN PATENT DOCUMENTS

| | | | |
|---|---|---|---|
| 0039558 | 11/1981 | European Pat. Off. | 15/79 R |
| 1321337 | 2/1963 | France | 15/41 R |
| 1377905 | 9/1964 | France | 15/41 R |
| 1191160 | 5/1970 | United Kingdom | 15/41 R |
| 2135869A | 9/1984 | United Kingdom . | |
| 8404663 | 12/1984 | World Int. Prop. O. | 15/41 R |

*Primary Examiner*—Edward L. Roberts

*Attorney, Agent, or Firm*—Wenderoth, Lind & Ponack

[57] ABSTRACT

A cleaner wherein a rotational cleaning member provided with blades extending radially therefrom is disposed in a casing the bottom of which is opened, and dust collecting boxes are disposed in the front and in the rear of the rotational cleaning member includes. To a roof portion of the casing to which a dust reflecting and introducing plate defined by first and second reflecting plates and a substantially V-shaped section is disposed. An apex angle portion of the reflecting and introducing plate is positioned close to a location which is somewhat lower than the top of the rotational cleaning member.

1 Claim, 3 Drawing Sheets

DUST REFLECTING AND INTRODUCING PLATE IN CLEANER

BACKGROUND OF THE INVENTION

1. Field of the Invention

This invention relates to a dust reflecting and introducing plate in a cleaner, and particularly to a dust reflecting and introducing plate by which dust can be efficiently introduced into dust collecting boxes.

2. Description of the Related Art

Heretofore, a rotating brush has been typically used as a rotational cleaning member in a cleaner, such rotating brush having a cylindrical shape and being constructed by radially disposing a number of bristles on a shaft. In typical ones of such cleaners, the rotating brush is rotated to spring up dust from a floor, and either the dust is directly introduced into a dust collecting box, or is conveyed to a prescribed dust collecting box by suction. Such a rotational cleaning member as described above disadvantageous in that the extreme end portions of the bristles tend to hold cotton-like materials such as pieces of thread, waste cotton and the like, so that the rotational cleaning member cannot transfer these cotton-like materials into a dust collecting box, but rather these materials remain wound around the rotating brush or caught therein, and the bristles become flattened thereby lowering the dust collecting efficiency of a cleaner. In order to eliminate the disadvantage described above, a comb teeth-like part is disposed to abut an outer peripheral portion of such a rotating brush to comb off pieces of thread, waste cotton and the like from the rotating brush thereby preventing the rotating brush from being wrapped by and retaining pieces of thread, waste cotton and the like. Such a countermeasure as described above, however, is not satisfactory, so that this problem had not been solved in this type of cleaner for many years.

In this connection, two types of cleaners have been proposed by the present applicant in Japanese Patent Application No. 216589/1982 entitled "Rotational Cleaning Member in Cleaner" and No. 154847/1984 entitled "Rotational Cleaning Member in Cleaner" each of which is intended to eliminate the aforesaid disadvantage presented by a conventional cleaner and to prevent its rotating brush from being wrapped with and retaining cotton-like materials such as pieces of thread, waste cotton and the like on a floor during cleaning, whereby smooth cleaning can be effected.

A rotational cleaning member in said cleaners is has a plurality of blades disposed on the outer peripheral surface of a rotating shaft and extending along the direction of the axis thereof. One end of the blades are fixed to the shaft and the blades extend radially therefrom. Each of the blades is made of a flexible elastic plate such as a rubber, synthetic resin, or metallic spring plate or the like. These blades bend sufficiently when they abut the surface of a floor, and an arbitrary number of the blades may be provided.

The rotating cleaning member is positively prevented from being wrapped by cotton-like materials such as pieces of thread, waste cotton or the like on the surface of a floor during cleaning, whereby smooth cleaning can be carried out.

However, it has been confirmed by the applicant that since a rotating cleaning member provided with the blades described above differs completely from a conventional rotating brush wherein a number of bristles are radially disposed on its shaft, the characteristic features of the applicant's rotating cleaning member are quite different from those of the conventional rotating brush.

More specifically, as shown in FIG. 5, the dust sprung up from the surface of a floor along the direction indicated by arrow A in a conventional rotating brush flies over a range indicated by reference characters a'–b', and collides with a roof portion of its casing. The dust which has collided with the roof portion in the vicinity of a' is introduced into a dust collecting box positioned in the front of a cleaner as indicated by reference character e'. On the other hand, the dust which has flown to a position b' is reflected in the vicinity of the top of the rotating brush in the direction of c', so that such dust can be introduced into a dust collecting box in the rear of the cleaner. In this case, however, a very small amount of dust passes through each gap defined between adjacent bristles of the rotating brush in the direction d', and as a result such dust returns to the surface of the floor.

One one hand, in the rotational cleaning member provided with blades which has been proposed by the present applicant, the dust sprung up from the surface of a floor in the direction indicated by arrow A is dispersed over a range indicated by reference characters a–b as shown in FIG. 6, and it is seen that such a range is somewhat wider than that or which dust is disposed by a conventional rotating brush, but not significantly so. The dust which has collided in the vicinity of a position a is contained in a dust collecting box positioned in the front of a cleaner as indicated by reference character e. The dust which has flown to the vicinity of a position b is reflected to return to the top of the rotational cleaning member, and part of the dust reflected to the top is introduced into a dust collecting box in the rear of the cleaner as indicated by reference character c. Most of the dust, however, drops through a gap defined between adjacent blades as indicated by reference character f, and as a result such dust returns to the surface of the floor as indicated by reference character d. As described above, since the rotational cleaning member provided with blades has quite different characteristic features from those of a conventional rotating brush but also allows dust to return to the floor, a device for efficiently introducing dust, which has been sprung up by means of a rotational cleaning member, into a dust collecting box has been desired.

OBJECT AND SUMMARY OF THE INVENTION

The present invention has been made in view of the above, and an object of the invention is to provide a dust reflecting and introducing plate which is closely disposed to a site being location disposed somewhat lower than the top of a rotational cleaning member in a cleaner in order to increase the dust collecting efficiency of a cleaner having a rotational cleaning member provided with blades.

BRIEF DESCRIPTION OF THE DRAWINGS

FIGS. 1–4 illustrate an example of the dust reflecting and introducing plate in a cleaner according to the present invention in which:

FIG. 1 is a bottom view showing the cleaner of the present invention;

FIG. 2 is a side view showing the cleaner of the present invention;

FIG. 3 is a sectional view, in elevation, taken along line II—III in FIG. 1;

FIG. 4 is an explanatory diagram showing a state in which dust is swept up and the manner in which the dust is contained;

DETAILED DESCRIPTION OF THE PREFERRED EMBODIMENT

Figure 1:
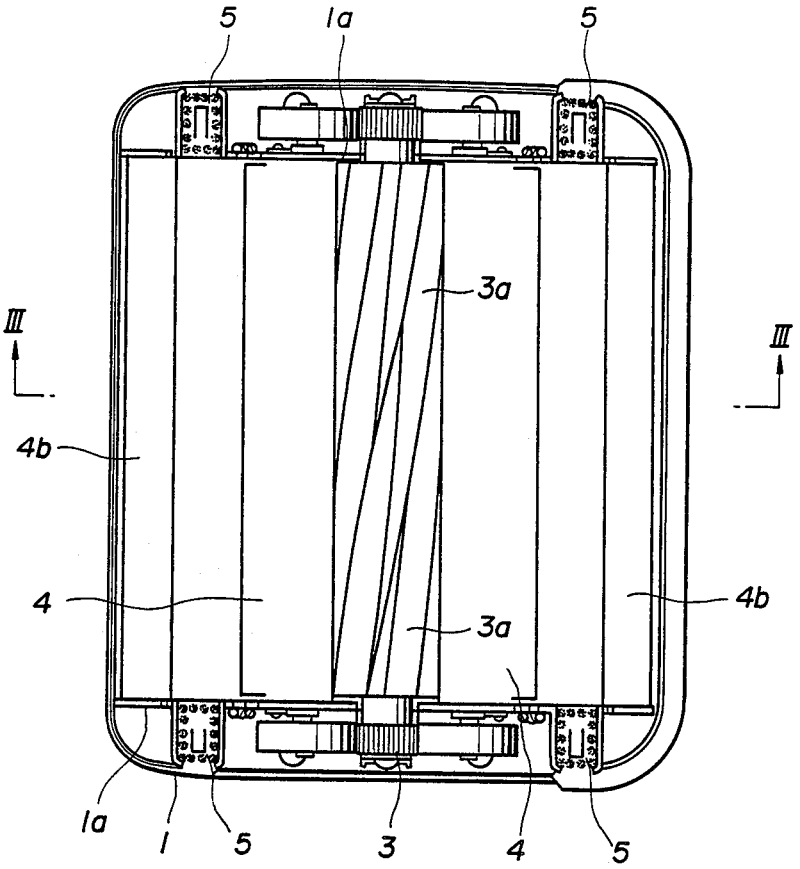
Figure 2:
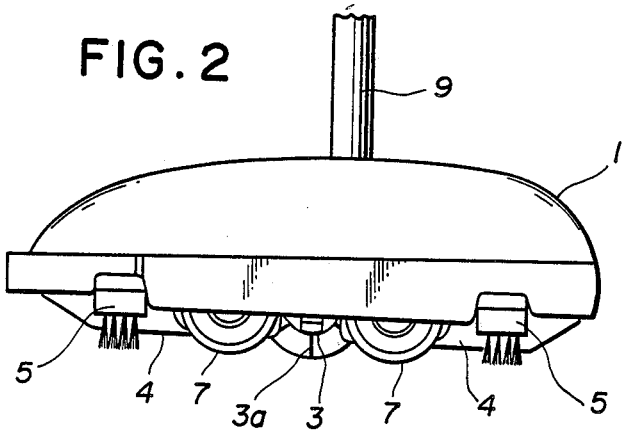

A dust reflecting and introducing plate in the cleaner according to the present invention will be described in detail hereinbelow by referring to the accompanying drawings.

The cleaner of the invention comprises a casing 1 the bottom of which is opened and provided with partition walls 1*a*, 1*a* on the opposite sides thereof, a rotational cleaning member 3 which is suspended in a vertically movable and rotatable manner by dampers (not shown) and which is disposed at a substantially central portion of each partition wall 1*a*, said rotational cleaning member 3 being provided with a plurality of blades 3*a* in the central portion thereof, and the rotational cleaning member 3 being transversely mounted in the central portion of the casing 1, dust collecting boxes 4, 4 each of which is disposed in the front and in the rear of the rotational cleaning member 3 respectively, and is positioned between the opposite partition walls 1*a* and 1*a*, corner brushes each of which is integrally formed with one of the dust collecting boxes 4, 4 and extends between the end of the casing 1 and each of the partition walls 1*a*, 1*a*, driving wheels each of which is positioned between an end of the casing 1 and one of the partition walls 1*a*, 1*a*, and is rotatably suspended by brackets (not shown) and is mounted on each of the partition walls 1*a*, 1*a* to drive the rotational cleaning member 3 and, at the same time, to support the casing 1 on a floor, a joint 8 movably disposed on a roof portion of the casing 1, and a travelling handle 9 connected to the joint 8. Each dust collecting box 4 is pivotally mounted to a revolving shaft 4*a* extending in a direction toward each of the partition walls 1*a*, 1*a* at a rear edge 4*b* thereof so that the dust collecting box 4 can be rotated around the revolving shaft 4*a* toward the lower part of the casing 1, whereby the dust collecting box may be freely opened and closed. A front edge of each dust collecting box 4 defines a leading edge 4*c* for guiding dust into the dust collecting box 4, the side walls 4*d*, 4*d* are disposed on the both sides of the leading edge 4*c*.

Figure 4:
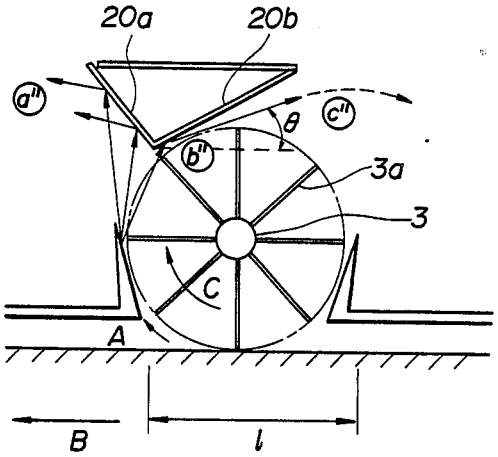
Figure 5:
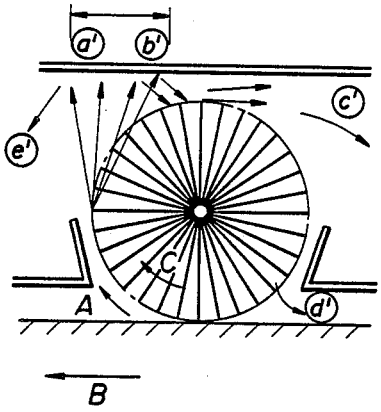
FIG. 5 is an explanatory diagram illustrating conventional rotating brushes for sweeping up dust.
Figure 6:
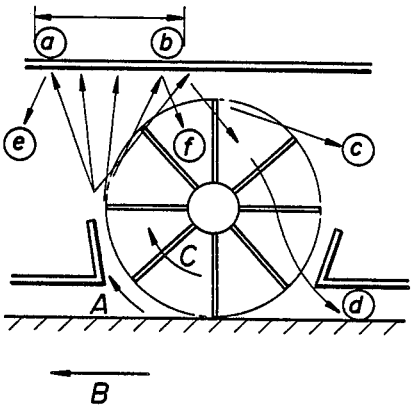
FIG. 6 is an explanatory diagram illustrating a rotational cleaning member provided with blades for sweeping up dust.

A spring member 12 is stretched between the casing 1 and each partition wall 1*a* to always urge the dust collecting box 4 toward casing 1 in a direction for closing it, and in its normal state, the dust collecting box 4 is closed under the urging force of the spring member 12. Furthermore, a dust reflecting and introducing plate 20 comprised of a first reflecting plate 20*a* and a second reflecting plate 20*b* is formed on a roof portion of the casing 1. The dust reflecting and introducing plate 20 has a substantially V-shaped section, an apex angle portion 20*c* of which is closely disposed to a location which is somewhat lower than the top of the rotational cleaning member 3, and the second reflecting plate 20*b* is is inclined at an acute angle $\alpha$ so as to follow a rotation locus of the blades 3*a* of in the rotational cleaning member 3. On the other hand, the first reflecting plate 20*a* is inclined at an angle $\beta$ so that reflected dust can directly drop into the front dust collecting box 4. As shown in FIG. 4, angle $\alpha$ is less than angle $\beta$ to facilitate the reflection of dust into each of the dust collecting boxes.

Figure 3:
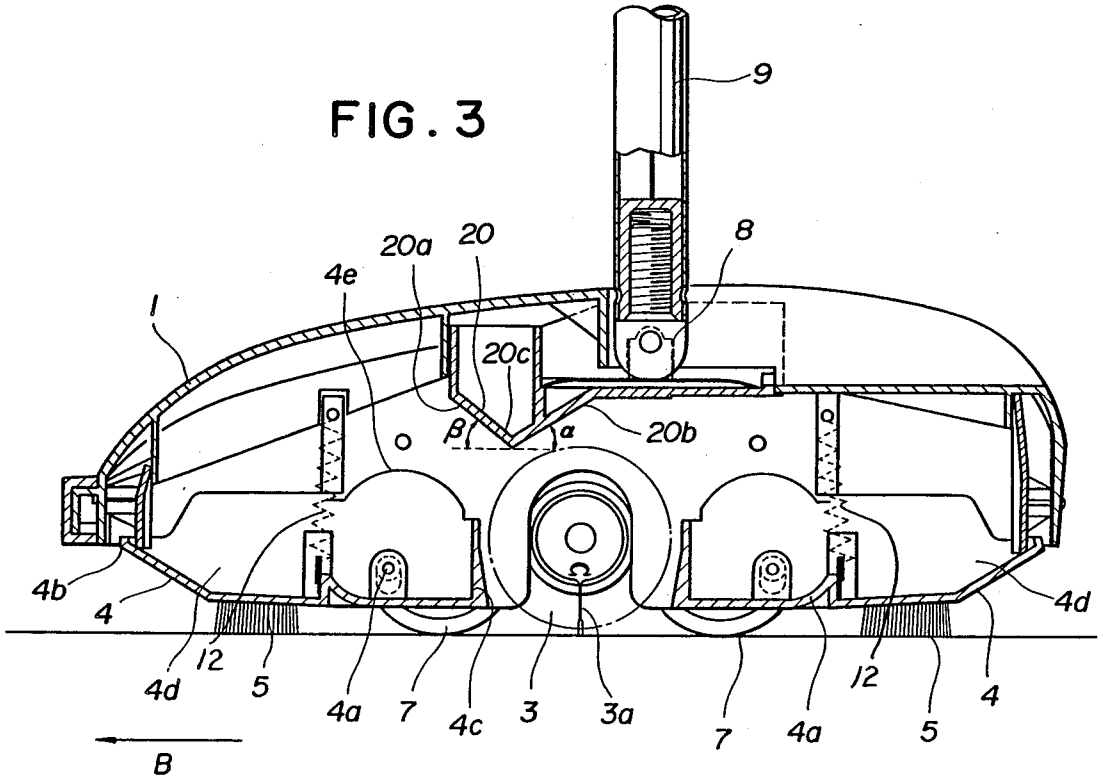

When the cleaner travels in the direction indicated by arrow B in FIG. 3, the rotational cleaning member 3 rotates in the direction indicated by arrow C in FIG. 4 to sweep up dust in the direction indicated by arrow A. Most of the dust swept upwardly is reflected by the first reflecting plate 20*a* in the direction indicated by reference character a″ and is introduced into the front dust collecting box 4. On one hand, the dust sent flying in the direction indicated by reference character b″ is scattered in the direction c″ by the second reflecting plate 20*b* disposed so as to reflect the dust at angle $\theta$, so that the dust is introduced in the rear dust collecting box 4. More specifically, since the dust which collided against the second reflecting plate 20*b* is reflected in the direction indicated by reference character c″, such dust can be sent flying over a sufficient distance l for reaching the rear dust collecting box, so that the dust is introduced in the rear dust collecting box 4. Thus, the amount of dust dropping toward the central axis of the rotational cleaning member through the blades 3*a* can be remarkably reduced. As a result, most of the dust once swept up in the direction A is introduced into the dust collecting boxes without returning to the floor.

As described above, the dust reflecting and introducing plate of the present invention comprises an apex angle portion which defines substantially V-shaped section and is disposed at a location which is somewhat lower than the top of the rotational cleaning member, and a reflecting plate disposed closer to the rotational cleaning member than the apex angle portion. Accordingly, dust once swept up can be efficiently introduced in dust collecting boxes, respectively.

I claim:

1. A cleaner for sweeping up dust and the like from the surface of a floor when the cleaner is moved in a forward direction over the surface, said cleaner comprising:

a casing having a roof portion, an open bottom opposite said roof portion, a front portion and a rear portion disposed behind said front portion with respect to the forward direction;

dust collecting boxes disposed, respectively, at the front portion and at the rear portion of said casing;

a rotational cleaning member rotatably mounted in said casing and disposed between said dust boxes for sweeping up dust and the like from the surface of the floor as the cleaner is moved in the forward direction, said rotational cleaning member having a shaft defining an axis of rotation of the cleaning member, and at least one blade extending radially from said shaft;

drive means operatively connected to said cleaning member for rotating said cleaning member in a rotational direction about said axis of rotation thereof as the cleaner is moved in the forward direction, said rotational direction being one in which a lowermost portion of the rotational cleaning member rotates away from the rear portion of said casing and toward the front portion of said casing while an uppermost portion of said cleaning member rotates away from the front portion of said casing and toward the rear portion of said casing; and a dust reflecting and introducing plate disposed on the roof portion of said casing adjacent said rotational cleaning member for reflecting the dust and the like swept up by said rotational cleaning member into said dust collecting boxes, said dust reflecting and introducing plate comprising a V-shaped section including first and second inclined plates intersecting at an apex angle portion, the apex angle portion disposed between said axis of rotation of said rotational cleaning member and the front portion of said casing at location in said casing somewhat lower than the uppermost portion of said rotational cleaning member, said first inclined plate extending from said apex angle portion toward the front portion of said casing, a first acute angle being defined between the horizontal and a surface of said first inclined plate that faces the front portion of said casing, and said second inclined plate extending from said apex angle portion toward the rear portion of said casing and to a location on the roof portion of said casing that is disposed between said axis of rotation of said rotational cleaning member and the rear portion of said casing, a second acute angle being defined between the horizontal and a surface of said second inclined plate that faces the rear portion of said casing, said second acute angle being smaller than said first acute angle.

* * * * *